United States Patent [19]

Phillip et al.

[11] Patent Number: 4,905,594

[45] Date of Patent: Mar. 6, 1990

[54] PAD-TYPE PRINTING MACHINE WITH AN INK FEEDING DOCTOR MECHANISM

[76] Inventors: Wilfried Phillip, Lenbachstrasse 8, D-7014 Kornwestheim; Heinz Cramer, Einsteinstrasse 56, D-7250 Leonberg, both of Fed. Rep. of Germany

[21] Appl. No.: 267,816

[22] Filed: Nov. 7, 1988

[30] Foreign Application Priority Data

Nov. 7, 1987 [DE] Fed. Rep. of Germany ..... 3737937

[51] Int. Cl.[4] ..... B41F 17/00; B41K 3/54

[52] U.S. Cl. ..... 101/163; 101/167

[58] Field of Search ..... 101/163, 167, 327, 379, 101/368

[56] References Cited

U.S. PATENT DOCUMENTS

| | | | |
|---|---|---|---|
| 3,468,252 | 9/1969 | Lemelson | 101/379 |
| 4,314,504 | 2/1982 | Combeau | 101/163 X |
| 4,557,195 | 12/1985 | Philipp | 101/167 X |

FOREIGN PATENT DOCUMENTS

| | | | |
|---|---|---|---|
| 0140165 | 9/1984 | European Pat. Off. . | |
| 1923374 | 2/1970 | Fed. Rep. of Germany | 101/163 |
| 7324837 | 7/1973 | Fed. Rep. of Germany . | |
| 2205430 | 6/1981 | Fed. Rep. of Germany | 101/163 |
| 239986 | 10/1986 | German Democratic Rep. | 101/163 |

*Primary Examiner*—Clifford D. Crowder

*Attorney, Agent, or Firm*—Helfgott & Karas

[57] ABSTRACT

A pad-type printing machine comprises a holding device for a printing block, an ink feeding mechanism including a hollow body which in operation of the machine has its end face in contact with the printing block, and a pressure mechanism for pressing the end face of the hollow body against the printing block. A device is also provided for generating a relative movement between the printing block and the hollow body. A pad or tampon is pressed upon the inked printing block for picking up ink from recesses of the printing block and transferring it to an object to be printed. The periphery of the end face of the hollow body is provided with a hard material. The hollow body of the printing mechanism is, in the area of its end face constructed so that it can be bent in this area, and the area is connected to the remaining part of the hollow body by a connection which permits relative movements between the area of the end face and the remaining part of the hollow body. The end face is thereby permitted to adapt itself to the surface of the printing block.

13 Claims, 4 Drawing Sheets

PAD-TYPE PRINTING MACHINE WITH AN INK FEEDING DOCTOR MECHANISM

BACKGROUND OF THE INVENTION

The present invention relates to a tampon printing machine comprising holding means for a printing block, an ink feeding mechanism including a hollow body which in operation of the machine has its end face in contact with the printing block, a pressure mechanism for pressing the end face of the hollow body against the printing block, means for generating a relative movement between the printing block and the hollow body, and a tampon which can be pressed upon the inked printing block for picking up ink from the recesses of the printing block and transferring it to an object to be printed, the periphery of the end face of the hollow body comprising a hard material.

A machine of this kind has been known from European Pat. No. 0,140,165. The ink reservoir and the part provided with the end face form together a largely rigid structure which does not permit the end face to follow any deviations of the surface of the printing block from an exactly defined plane. If excellent printing results are to be obtained, it is a requirement in the case of the known machine that the surface of the printing block be extremely plane and that any deviations from the plane may not in any case exceed a maximum of 10 μm. Consequently, the use of steel printing blocks is preferred in the case of the known printing machines.

SUMMARY OF THE INVENTION

Now, it is an object of the present invention to provide a machine of the type described above which is generally suited for use of plastic printing blocks whose surfaces generally exhibit larger deviations from a given plane than high-precision steel printing blocks. On the other hand, however, the advantages provided by highly wear resistant end faces are to be maintained so that the use of soft plastic materials for the end face, for example, has to be ruled out.

This object is achieved by the fact that the hollow body is designed, in the area of its end face, so that it can be distorted or bent in this area and that the said area is connected to the remaining part of the hollow body by a connection permitting relative movements to occur between the said area of the end face and the remaining hollow body. It is an advantage of this arrangement that the end face and/or the area of the hollow body immediately adjacent the end face can move relative to the remaining parts of the hollow body so that the bending resistance normally exhibited by the hollow body due to its tubular shape is not transferred to its end face as well. Preferably, the connection permitting the described relative movements also enables the part carrying the end face to turn about several axes relative to the remaining parts of the hollow body (ink reservoir or pot). Due to the fact that the end face is permitted to perform the before-described movement, it is also easily capable of following a surface of a printing block which exhibits greater unevenness than a high-precision steel printing block, and of adapting itself to such a surface by bending and, if necessary, by torsion.

This particular advantage is achieved especially in cases where the ink reservoir is held exclusively at a point near its end face, which forms a wiper edge, while the parts of the ink reservoir located above this area are not supported separately in parts of the machine. The advantageous characteristics of the invention are due in this case also to the fact that given the bending and distortion properties of the part of the ink reservoir comprising the end face, relative to the remaining parts thereof, these latter need not follow the bending or turning movements of the end face so that the mass moment of inertia, or the inertia moment of the upper parts of the ink reservoir does not hinder the end face to adapt itself rapidly to the slight irregularities of the surface of the printing block.

The invention makes the tampon printing machine and the ink reservoir suited not only for processing plastic printing blocks, but also for use of steel printing blocks because the end face of the ink reservoir is rendered capable of following more easily any slight irregularities of the surface which may exist also in the case of steel printing blocks, and this helps reduce the wearing effect which an end face made of an hard material and coated preferably by a carbide metal or other hard material normally has on the printing block, leading thus to an extension of the service life of the printing block.

Generally, it can be regarded as sufficient if the ratio of the diameter of the end face (in the case of an annular end face) to the possible distortion (maximum deviation of the printing block from the absolutely plane form) is approximately 300 to 1,500 for plastic printing blocks, and approximately 1,000 to 5,000 for steel printing blocks. A pot (ink reservoir) whose end face has a diameter of 60 mm and is permitted to bend by 0.02 mm in the longitudinal direction of the pot and, accordingly, in a direction perpendicular to the surface of the printing block, comes within this latter range.

The structure of an ink reservoir according to the invention can be achieved in different ways. According to one embodiment of the invention it is provided that the connection is formed by areas of the hollow body which extend at an angle different from zero relative to the longitudinal axis of the hollow body which extends at a right angle to the surface of the printing block. These areas, which must of course also be sufficiently thin, constitute sort of a diaphragm enabling the area comprising the end face to be bent and distorted relative to the remaining parts of the ink reservoir.

According to another embodiment of the invention it is provided that the areas extending at the described angle are designed in the form of bellows. In this case, several areas extending substantially transversely to the before-mentioned longitudinal direction of the hollow bodies are arranged in series.

According to one embodiment of the invention it is provided that the area of the hollow body comprising the end face is connected to the other parts of the hollow body via at least one elastic part made from rubber or a plastic material. In particular, it is possible in this case to produce separate parts and to interconnect them thereafter by the elastic part.

According to one embodiment of the invention it is provided that the pressure mechanism comprises three points acting upon upwardly directed surfaces of the hollow body provided on a pressure ring upon which a contact pressure is applied at two points of a diametral line. One advantage of this solution is seen in the fact that when applying the contact pressure upon the end face in this manner, the latter is pressed against the printing block at three points which favors its adaptation to a possibly uneven printing block surface. Preferably, the three points are distributed evenly over the periphery (at angles of 120°). Advantageously, the three points are subjected to approximately equal forces. It is of advantage for this purpose if the pressure ring is substantially rigid and the two forces introduced into the ring at two points are equal in magnitude. In addition, it is of advantage for this purpose if the beforementioned diametral line is set off by 30° from one of the points which are distributed over the periphery at spacings of 120°.

Instead of pressing the pressure ring against the part carrying the end face at two points, which are rigidly connected with the pressure ring, one may also exert a contact pressure upon this part at more than three points. The forces are then transferred via elastic elements, in particular separate springs, or by means of a single elastic ring, for example a rubber-elastic ring in the form of an O-ring provided on the pressure ring. The contact pressure is then introduced into the end face at an infinite number of points which enables the end face to adapt itself perfectly to the surface of the printing block.

According to one embodiment of the invention it is provided that the drive means for the relative movement between the hollow body and the printing block comprises a cam arranged for being set into rotary movement, that a pivoted lever is provided with two supporting rollers engaging a cam in such a manner that the lever can be pivoted by the cam in two directions, and that the lever is coupled with the parts to be moved. The advantage of this arrangement lies in the fact that the drive (in the embodiment the drive of the printing block) can be realized in a simple manner.

According to one embodiment of the invention it is provided that a drive mechanism for the tampon comprises a cam that can be set into rotary movement, that a pivoted lever is provided with two supporting rollers engaging the cam in such a manner that the lever can be pivoted by the cam in two directions, and that the tampon is coupled with the lever. An advantage of this arrangement is seen in the fact that the drive of the tampon can be realized in a simple manner.

According to one embodiment of the invention it is provided that the cams are coupled to rotate together with each other, and are preferably arranged on the same shaft. It is regarded as an advantage of this embodiment that it permits exact tuning and synchronism of the movements of the tampon and of the printing block (or of the ink reservoir, where the latter is driven).

According to one embodiment of the invention it is provided that the cam is formed by two cam disks which are arranged parallel to each other and which by any known means can be adjusted relative to each other with respect to the rotary axis of the cam, and that each of the two supporting rollers of the lever is in engagement with one of the cam disks. An advantage of this arrangement is seen in the fact that it facilitates the adjustment of a condition where the lever is driven free from play.

According to one embodiment of the invention it is provided that the position of the pivot point of the lever can be adjusted. It is an advantage of this solution that it also facilitates the adjustment of a condition where the lever is driven free from play.

Compared with pneumatically controlled machines, it is an advantage of the machine comprising a mechanical drive for the tampon and for the relative movement between the printing block and the ink reservoir that the machine can be run at particularly high speeds due to the fact that all movements are positively controlled, and not least because there is no need to determine first by separate sensors if specific machine parts have actually reached their desired position.

The present invention relates further to a hollow body for use in a tampon printing machine. According to the invention, the hollow body is designed as described above. The advantages of this design can be achieved also when the hollow body is used in other machines.

Further features and advantages of the invention will appear from the following description of certain embodiments of the invention with reference to the drawing which illustrates certain details which are essential to the invention, and from the claims, it being understood that the individual features can be employed in any embodiments of the invention either individually or in any desired combination.

DESCRIPTION OF THE PREFERRED EMBODIMENTS

The drawings are largely schematized and show only those details which are necessary for the reader to understand the invention. The sliding guides for the printing block or the printing block holder are not shown for the sake of simplicity.

Figure 1:
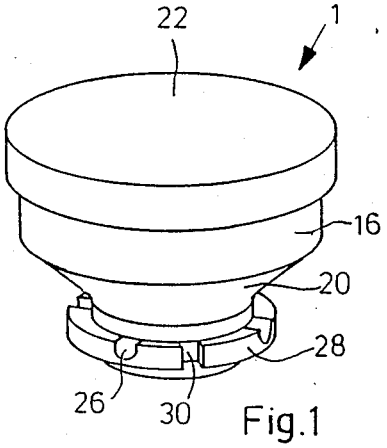
FIG. 1 is a perspective view of a first embodiment of an ink reservoir.
Figure 2:
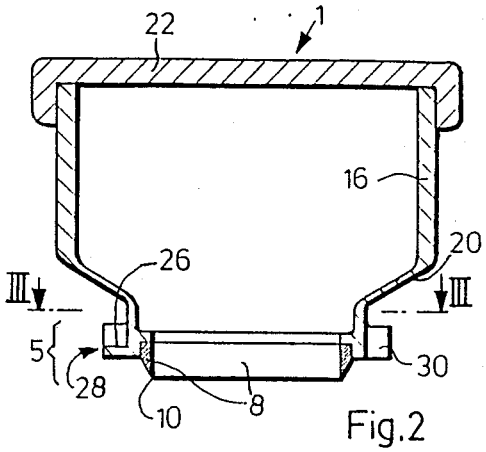
FIG. 2 shows a longitudinal section through the ink reservoir illustrated in FIG. 1.

Referring now to FIGS. 1 and 2, an ink reservoir 1 is open at its bottom and provided in this area with a lower portion 5 which includes a shaped insert 8 made from a hard material. The insert 8 ends at its bottom in a narrow end face 10. When inking a printing block provided with recesses with a pasty ink contained inside the reservoir 1, the insert 8 serves to wipe off excessive ink during the relative movement between the printing block and the ink reservoir 1 and performs in this manner the function of a doctor blade. The lower portion 5, including the insert 8, is sized in such a manner that it can be bent and distorted slightly, i.e. to the extent described at the outset to adapt itself to any unevenness or waviness of a printing block to be processed. In order to prevent the lower portion 5 from being reinforced in an undesirable manner by relatively rigid parts 16 of the ink reservoir 1 arranged above the portion 5, the connection between the lower portion 5 and the upper portion 16 consists of a diaphragm-like transition piece 20 formed integrally with the part 16 and extending transversely to the longitudinal axis of the ink reservoir 1, which extends from the bottom to the top in FIG. 2. The transition piece 20 has a thickness smaller than that of portion 16 and acts as a flexible diaphragm which does not notably increase the rigidity of the lower portion 5. The lower portion 5 is thus permitted to bend and to be distorted, and generally to turn about several axes relative to the upper portion 16. The ink reservoir 1 is provided with a cover 22 which is intended to prevent the solvent from evaporating and dirt from entering the ink.

Figure 3:
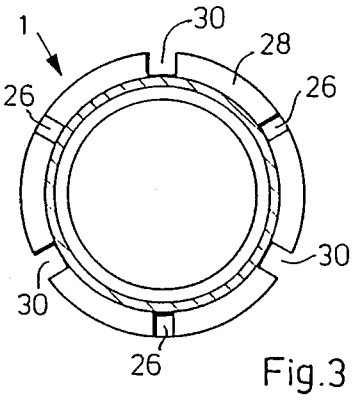
FIG. 3 shows a section taken along line III—III in FIG. 2.
Figure 12:
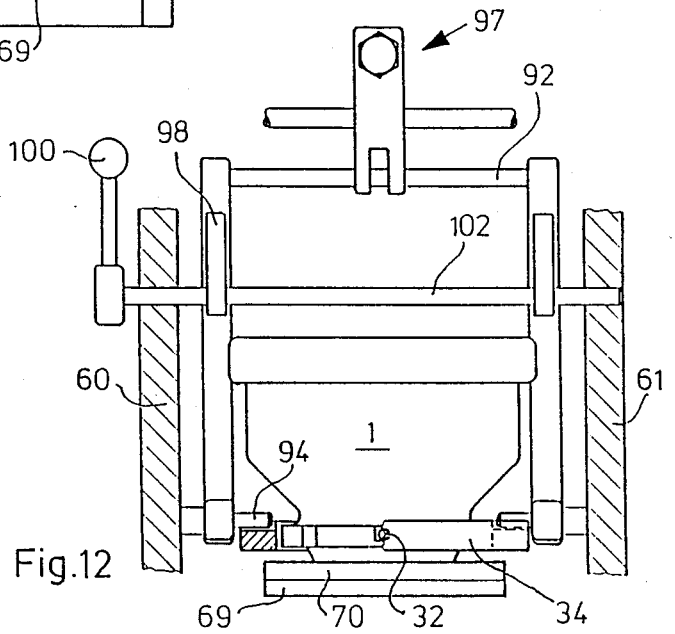
FIG. 12 is a front view, from the left in FIG. 10.
Figure 10:
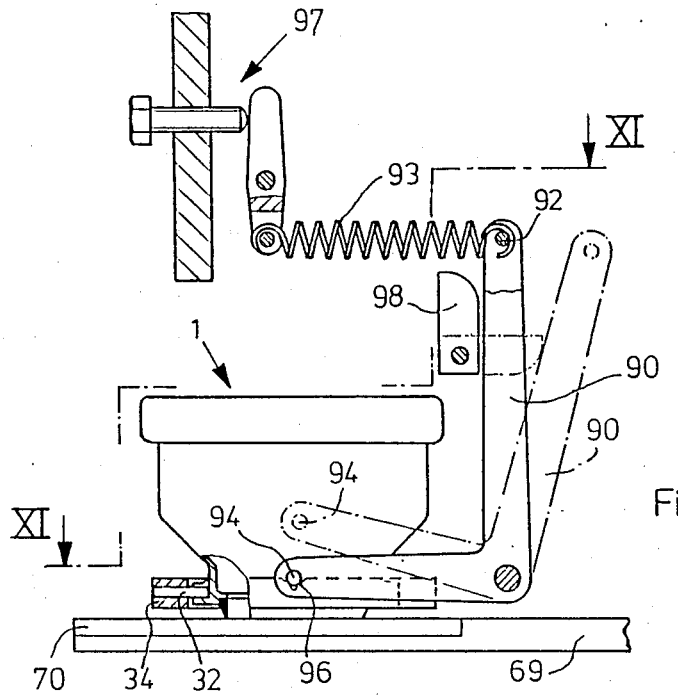
FIG. 10 shows a side view of certain details of the pressure mechanism for the ink reservoir.

FIG. 3 shows three contact surfaces 26 for two pins 32 (FIG. 10) of a pressure ring 34 provided on an all-round rim 28. In order to enable the ink reservoir 1 to be detached from the pressure ring 34 at desire, the rim 28 is provided with three recesses 30 so that the ink container 1 can be lifted off after the pressure ring 34 has been turned into the appropriate position. As will be explained further below, the pressure ring 34 in turn is subjected to the action of two spring-loaded pins 94 (FIG. 12) whose connecting line is displaced by an angle of approximately 30° relative to one of the surfaces 26.

Figure 4:
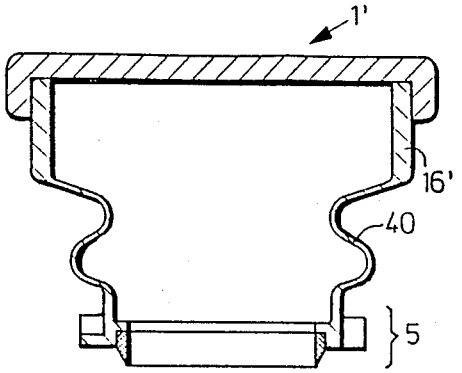
FIGS. 4 to 6 show longitudinal sections through other embodiments of an ink reservoir.

Regarding now the embodiment illustrated in FIG. 4, the lower portion 5 of the upper part of the ink reservoir 1', which is designated by reference numeral 16' in this figure, is connected with the lower part by means of a wall 40 of reduced thickness in the form of a bellows which likewise enables the lower portion 5 to bend and to be distorted freely.

Figure 5:
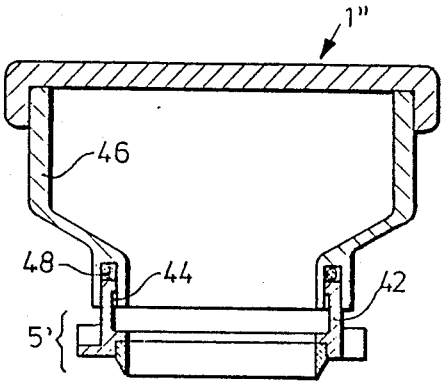

In the embodiment shown in FIG. 5, the lower portion 5' and the remaining part of the ink reservoir 1'' are designed as separate parts. An upwardly extending tubular projection 42 of the lower portion 5'' engages a downwardly open annular groove 44 in the upper part 46 of the reservoir. An elastic seal 48 in the form of an O-ring is fitted in the annular groove 44 above the tubular portion 42. Being somewhat narrower than the space provided for it, the O ring can be compressed a little whereby decoupling of the lower portion and the upper portion 46 of the ink reservoir 1' is guaranteed.

Figure 6:
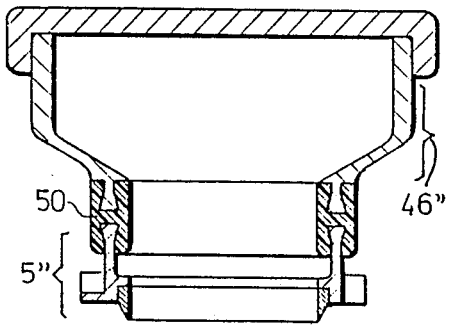

The embodiment illustrated in FIG. 6 includes an upper portion 46'' and a separate lower portion 5'' which are connected by means of a molded-on collar 50 of a rubber-elastic material, in particular rubber, which provides an elastic connection to the lower portion 5''. Instead of rubber, a plastic material may be used.

Figure 7:
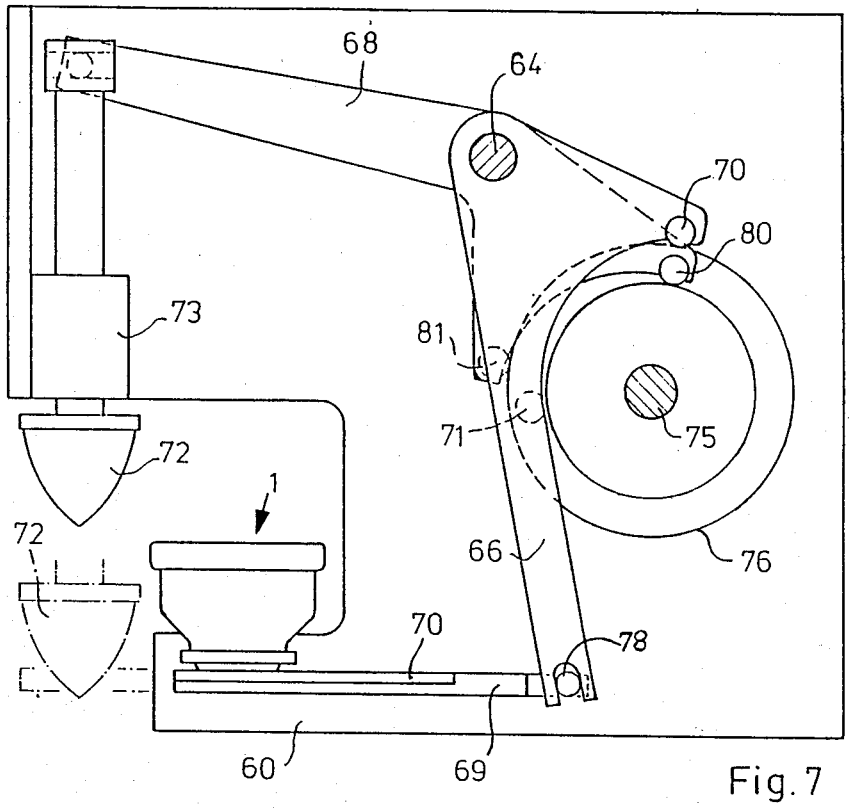
FIG. 7 shows a side view of the essential parts of a tampon printing machine, without the details of the mounting means of the ink reservoir, cut along line VII—VII in FIG. 8.
Figure 8:
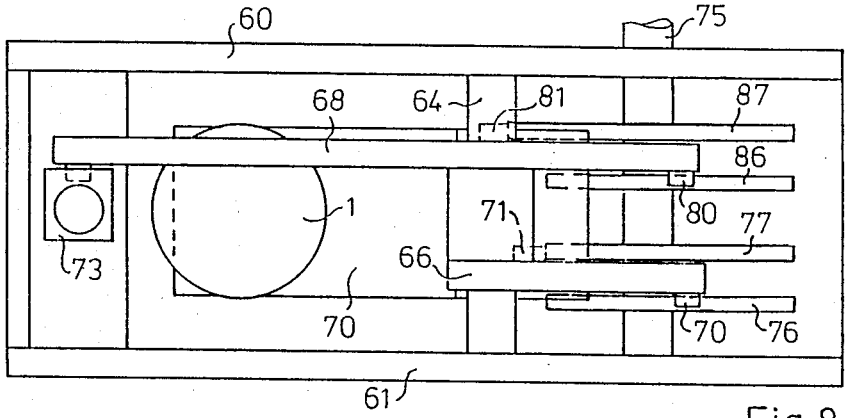
FIG. 8 is a top view of the machine illustrated in FIG. 7.
Figure 9:
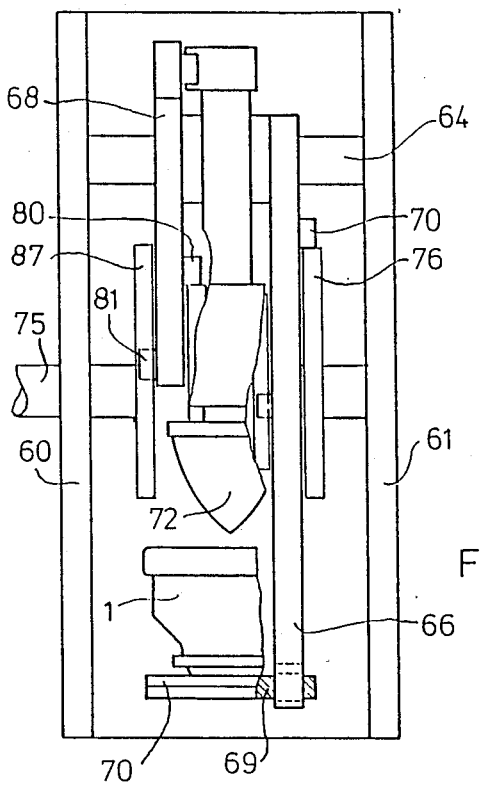
FIG. 9 is a view of the machine in FIG. 7, from the left in FIG. 7, with certain parts broken away.

The tampon printing machine illustrated in FIGS. 7 to 9 comprises a machine frame composed essentially of two side plates 60 and 61 and supporting a king pin 64 on which a first lever 66 and a second lever 68 are seated for rotary movement. The first lever 66 serves for ensuring the horizontal drive for a printing block carrier 69 which is not shown in detail in the drawing and which carries a detachable printing block 70. The second lever 68 serves for ensuring the vertical drive for a tampon or pad 72 which is mounted for displacement in a guide 73.

The first lever 66 is provided with two supporting rollers 70 and 71 coacting each with one cam disk 76 or 77 fixed on a shaft 75, the supporting rollers 70 and 71 bearing against outer surfaces of the cam disks which extend in parallel to the longitudinal axis of the shaft 75. The cam disks 76 and 77 are capable of rotating relative to each other and can be fixed in position on the shaft 75 so that—when the shape of the cam disk 76, 77 is selected appropriately, the positions which the first lever 76 occupies at any time are positively controlled and any undesirable play is prevented. If desired, the king pin 64 may be arranged on mounting means which can be adjusted relative to the machine frame so that the desired freeness from play can be achieved more easily, by varying the position of the pivot axis of the lever 66. It may be convenient in this connection to provide a separate pivot point for the second lever 68 which may also be variable independently of the pivot point of the first lever 66. During rotation of the shaft 75, the first lever 66 is pivoted to and fro by the cam disks 76, 77. An oblong hole 78 provided at the lower end of the first lever 66 is engaged, preferably via a so-called rocker arm or sliding piece, by a bolt which is connected with the printing block or carrier of the printing block 70. The cam disks may, if required, be replaced also by cam grooves.

The shaft 75 carries additional cam disks 86 and 87 mounted thereon against rotation and engaging supporting rollers 80, 81 of the second lever 68 for driving the latter in a manner similar to that described for the drive of the first lever 66. The cam disks 86, 87 are also adjustable relative to each other and can also be fixed in position. Given the fact that the cam disks 76, 77, 86, 87 are fixed on the shaft 75 against rotation, a locked-phase relationship is ensured between the drive of the printing block 70 and that of the tampon 72. The manner in which the shaft 75 is driven is not illustrated in the drawing for the sake of simplicity. The shaft 75 may either be passed through one of the side walls 60, 67, or may be coupled at this point with a drive motor, or may be provided with a gear which may be firmly coupled with the drive means of a production line.

Figure 11:
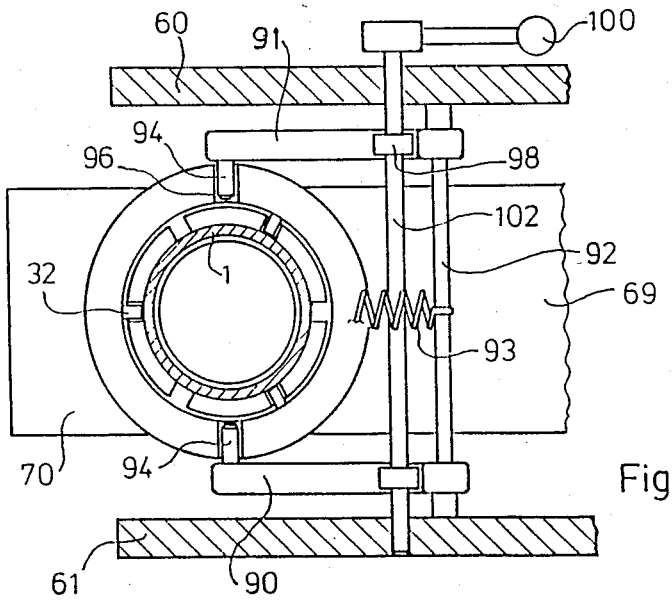
FIG. 11 is a sectional view along line IX—IX in FIG. 10.

The ink reservoir 1 is stationary in operation of the machine. Its end face is pressed against the printing block by a pressure mechanism of the type illustrated in FIGS. 10 to 12. The pressure mechanism comprises two spaced and parallel elbow levers 90, 91 whose upwardly extending arms are loosely interconnected by a rod 92. A tension spring 93 whose active length and, thus, tension can be varied by means of adjusting means 97, acts exactly upon the center point of the rod 92. The two other arms of the two levers 90, 91 which in operation extend approximately horizontally, carry each one pin 94 which extend in the horizontal direction and towards each other.

In operation of the machine, the pins 94 engage contact surfaces 96, which in the embodiment shown have the form of a recess and are provided at two diametrically opposite points of the upside of the ring 34. The connection line between the pins 94 is set off by an angle of 30° relative to two of the pins 32. The levers 90, 91 being permitted to pivot a little relative to each other, as a result of their loose connection by the rod, equal forces are always exerted upon those pins 94.

The upwardly extending arms of the levers 90, 91 are not in engagement with their associated switching cams 98 which are in driving connection with a hand lever 100, via a shaft 102. When the hand lever 100 is rotated, the switching cams 98 and the levers 90, 91 assume the positions indicated in FIG. 10 by dash-dotted lines, whereby the pins 94 are lifted off the ring 34 so that the reservoir 1, together with the ring 34, can be moved out of the area of the pressure mechanism.

For detaching the reservoir 1 from the machine, a coupling piece is provided which is fixed magnetically to one machine part and whose surface is exactly aligned with the surface of the printing block. The ink reservoir 1 can be pushed onto the coupling piece, without any ink flowing out, and can then be lifted off the machine together with the coupling piece. A new reservoir can be mounted in the machine in the same manner, after replenishing or when a different ink is required. Given the fact that the ink reservoir stands almost absolutely free in the machine, it is of course easily accessible for the described exchange. Moreover, it is possible to keep several such reservoirs on stock, and the downwardly projecting end face of these reservoirs may also have different diameters and can still be pressed against the printing block by the same pressure mechanism. In addition, it is also possible to detach the printing block 70 from its carrier and to remove it from the machine together with the ink reservoir placed thereon.

Due to the fact that the tension of the spring 93 can be varied, the pressure by which the ink reservoir is pressed against the printing block can be varied infinitely and, accordingly, adapted to the printing block used in the particular case, and its material.

Apart from the possibilities described above, the drive of the machine may be realized also by a frequency-controlled motor or by a chain which couples the machine with other mechanisms and machines of a production line in locked-phase relationship.

The cam disks driving the tampon are preferably designed in such a manner that once the tampon 72 has picked up the ink from the printing block, which is the case when the printing block has been displaced from its position shown in FIG. 7 to the left, into the position indicated by dash-dotted lines, it remains exposed to the air as long as possible, before the printing operation is carried out, it having been found that in this case the ink will be transferred particularly well to the object to be printed. Due to the use of the cam disks it is easily possible to make the period of time during which the ink is picked up from the printing block as short as possible and to make the period of time before the tampon gets into contact with the object to be printed as long as possible.

When plastic printing blocks are to be processed, the surface of the ink reservoir which gets into contact with the printing block may be made from steel, preferably from tool steel. Other materials are of course also possible. In other cases, it may be convenient to provide this part of the ink reservoir with a hard material, in particular in the area of its surface. Even an insert 8 which is integrally made from a hard material may provide the necessary flexibility, provided its dimensions are properly selected.

The kinematics described for the drive of the printing block and of the tampon can be used for different machine sizes. At present it is believed that machine sizes in the range of lengths of between approximately 35 cm to 100 cm are suited. The other dimensions can be roughly derived from these dimensions, FIGS. 7 to 9 being insofar approximately true to scale.

In the illustrated embodiment, the insert 8 comprising the end face (wiping lip or doctor blade edge) is made from a carbide metal. It has an outer diameter of approximately 64 mm, an inner diameter of approximately 59 mm and a height of approximately 5 mm.

It is expected that cycle speeds of approximately 10,000 to 12,000 cycles per hour can be reached with the design according to the invention.

Given the bending properties and flexibility of the lower portion of the ink reservoir or ink pot, lower pressures are required in the case of the invention than with conventional machines. The machine and the ink reservoir according to the invention are therefore suited for higher operating speeds, and lead to extended service lives of the printing blocks, as compared with machines according to the prior art.

The solution described above, namely to press the wiper edge against the printing block at a very large number of points, by means of an elastic annular element arranged at the pressure ring, is particularly well suited in cases where the end face of the reservoir has a relatively narrow clear cross-section, i.e. in the form of a narrow rectangle whose narrow edge extends in the direction of displacement of the printing block, or in the form of a narrow ellipse.

The end face 10 of the ink reservoir is microfinished to a peak-to-valley height of maximally 2 $\mu$m.

We claim:

1. Pad-type printing machine comprising holding means for a printing block, an ink feeding doctor mechanism including a hollow body which in operation of the machine has its end face in contact with the printing block, a pressure mechanism for pressing the end face of the hollow body against the printing block, means for generating a relative movement between the printing block and the hollow body, and a pad which can be pressed upon the inked printing block for picking up ink from recesses of the printing block and transferring it to an object to be printed, the periphery of the end face of the hollow body comprising a hard material, said hollow body being constructed in the area of its end face so that it can be bent in said area and said area is joined to the remaining part of said hollow body by a connection means permitting relative movements to occur between said area of said end face and the remaining part of said hollow body, said pressure mechanism including means which act on said end face only at predetermined constant points of the periphery of said end face.

2. Machine according to claim 1, wherein said end face is circular and the ratio of the diameter of said end face of said hollow body to a possible bending displacement is in the range of approximately 300 to 5,000.

3. Machine according to claim 1, wherein said connection means is formed by areas of said hollow body which are inclined relative to a longitudinal axis of said hollow body which extends essentially orthogonally to a surface of said printing block.

4. Machine according to claim 3, wherein said inclined areas are provided in the form of bellows.

5. Machine according to claim 1, wherein said end face is connected to the remaining part of said hollow body via at least one elastic part made from a material selected from the group consisting of rubber and plastic material.

6. Machine according to claim 1, wherein said means of said pressure mechanism comprises a pressure ring having at least three contact points acting downwardly in the direction of said printing block and engaging on upwardly directed engagement surfaces of said hollow body, wherein contact pressure is applied at two points of a diametral line of said pressure ring.

7. Machine according to claim 6, wherein said three contact points are distributed over the periphery of said hollow body and are evenly spaced from each other by an angle of 120°.

8. Machine according to claim 6, wherein said pressure ring bears against a part carrying said end face at more than three points, via at least one elastic element.

9. Machine according to claim 1, wherein said means for generating the relative movement between said hollow body and said printing block comprises a first cam arranged for being set into rotary movement, a pivoted lever provided with two supporting rollers engaging said first cam in such manner that said lever can be pivoted by said cam in two directions, said lever being coupled with parts to be moved.

10. Machine according to claim 9, wherein the position of the pivot point of said lever can be adjusted.

11. Machine according to claim 9, and comprising a drive mechanism for said pad, said drive mechanism including a second cam that can be set into rotary movement, a second pivoted lever provided with two supporting rollers engaging said second cam in such a manner that said second lever can be pivoted by said second cam in two directions, said pad being coupled with said second lever, and said first and second cams being coupled to rotate together with each other and being arranged on the same shaft.

12. Machine according to claim claim 11, wherein said first and second cams are formed by two cam disks which are arranged parallel to each other and which can be adjusted relative to each other with respect to a rotary axis of a respective cam, and each of the two supporting rollers of each lever being in engagement with a respective one of the cam disks.

13. Machine according to claim 1, and comprising a drive mechanism for said pad, said drive mechanism including a cam that can be set into rotary movement, a pivoted lever provided with two supporting rollers engaging said cam in such a manner that said lever can be pivoted by said cam in two directions, and said pad being coupled with said lever.

* * * * *

UNITED STATES PATENT AND TRADEMARK OFFICE

CERTIFICATE OF CORRECTION

PATENT NO. : 4,905,594

DATED : March 6, 1990

INVENTOR(S) : WILFRIED PHILIPP ET AL.

It is certified that error appears in the above-identified patent and that said Letters Patent is hereby corrected as shown below:

ON TITLE PAGE: line 76 should read as follows:

[76] Wilfried Philipp, Lenbachstrasse 8, D-7014 Kornwestheim; Heinz Cramer, Einsteinstrasse 56, D-7250 Leonberg, both of Fed. Rep. of Germany Add new line 73 as follows:

[73] Assignee: Tampoprint GmbH D-7015 Korntal-Munchingen/Federal Republic of Germany

Signed and Sealed this

Twenty-second Day of October, 1991

*Attest:*

*Attesting Officer*

HARRY F. MANBECK, JR.

*Commissioner of Patents and Trademarks*